US009437125B2

(12) United States Patent
Chen

(10) Patent No.: US 9,437,125 B2
(45) Date of Patent: Sep. 6, 2016

(54) METHOD AND DEVICE FOR OBTAINING IMAGE SIGNALS

(71) Applicant: SHENZHEN CHINA STAR OPTOELECTRONICS TECHNOLOGY CO., LTD, Shenzhen (CN)

(72) Inventor: Lixuan Chen, Shenzhen (CN)

(73) Assignee: SHENZHEN CHINA STAR OPTOELECTRONICS TECHNOLOGY CO., LTD, Shenzhen (CN)

( * ) Notice: Subject to any disclaimer, the term of this patent is extended or adjusted under 35 U.S.C. 154(b) by 114 days.

(21) Appl. No.: 14/131,911

(22) PCT Filed: Dec. 24, 2013

(86) PCT No.: PCT/CN2013/090301

§ 371 (c)(1),
(2) Date: Jan. 10, 2014

(87) PCT Pub. No.: WO2015/089857

PCT Pub. Date: Jun. 25, 2015

(65) Prior Publication Data

US 2015/0170583 A1 Jun. 18, 2015

(30) Foreign Application Priority Data

Dec. 17, 2013 (CN) ..... 2013 1 0693359

(51) Int. Cl.

| | |
|---|---|
| ***G09G 3/34*** | (2006.01) |
| ***G09G 3/00*** | (2006.01) |
| *G09G 3/36* | (2006.01) |

(52) U.S. Cl.

CPC ..... *G09G 3/003* (2013.01); *G09G 3/3611* (2013.01); *G09G 2320/0209* (2013.01); *G09G 2320/0271* (2013.01)

(58) Field of Classification Search

CPC ..... G09G 2300/0842; G09G 3/3233; G09G 2320/043

See application file for complete search history.

(56) References Cited

U.S. PATENT DOCUMENTS

2004/0155837 A1 8/2004 Yu et al.
2006/0262147 A1* 11/2006 Kimpe ..... G09G 3/20 345/690

(Continued)

FOREIGN PATENT DOCUMENTS

CN 1828713 A 9/2006
CN 1873770 A 12/2006

(Continued)

*Primary Examiner* — Andrew Sasinowski
*Assistant Examiner* — Mansour M Said
(74) *Attorney, Agent, or Firm* — Mark M. Friedman

(57) ABSTRACT

The present invention provides a method and a device for obtaining image signals. The method comprising steps of: measuring a luminance signal of a grayscale switching screen of a to-be-sampled grayscale; and processing the luminance signal of the grayscale switching screen of the to-be-sampled grayscale by a two-dimensional nonlinear fitting operation which is executed based on a two-dimensional least squares method. The present invention further provides the device for obtaining image signals. The present invention introduces the two-dimensional nonlinear fitting operation to the luminance signal of the grayscale switching screen of the to-be-sampled grayscale, so as to efficiently obtain luminance signals of different grayscale switching screens.

1 Claim, 4 Drawing Sheets

(56) References Cited

U.S. PATENT DOCUMENTS

| | | | | |
|---|---|---|---|---|
| 2006/0274217 | A1 | 12/2006 | Bae et al. | |
| 2008/0001881 | A1* | 1/2008 | Baba | G09G 3/3406 345/89 |
| 2013/0342585 | A1* | 12/2013 | Chun et al. | 345/690 |
| 2014/0300650 | A1 | 10/2014 | Dai et al. | |

FOREIGN PATENT DOCUMENTS

| | | | |
|---|---|---|---|
| CN | 102968979 | A | 3/2013 |
| CN | 103165096 | A | 6/2013 |

* cited by examiner

METHOD AND DEVICE FOR OBTAINING IMAGE SIGNALS

FIELD OF THE INVENTION

The present invention relates to the field of processing signals, and more particularly to a method and device for obtaining image signals.

BACKGROUND OF THE INVENTION

With the development of the society, more and more users are using liquid crystal displays (LCDs) to process social activities, and more particularly they are using 3D shutter LCD devices which fully satisfy the users' need to watch 3D movies. A 3D shutter LCD device displays signals of the left eye and the right eye by screens of different frames during use, so that the frequencies of the screens are frequently refreshed. When the signals of the left eye and the right eye are switched, the switching time interval is short, and the crosstalk could easily be produced.

In order to avoid the crosstalk of screens, a 3D shutter LCD device processes the over drive when changing the signals of the left eye and the right eye, so that the switching time interval of the signals of the left eye and the right eye is reduced to avoid the crosstalk.

Therefore, setting luminance signals of different grayscale switching screens of a 3D shutter LCD device (in the condition of luminance signals, the crosstalk can be prevented.) need to be carried out by measuring 256×256 luminance signals when switching (i.e. the grayscale of the left screen is fixed, and luminance signals of 256×256 right eye screens can be measured after switching; then, the grayscale of the left screen is switched, and luminance signals of 256×256 right eye screens can be measured after switching, until the grayscale of the left screen has been switched 256 times), or by measuring 64×64 luminance signals when switching, and then the measured result is processed by linear interpolation.

No matter what the methods adopted for measuring the luminance signals of 256×256 or 64×64 grayscales, the methods need to processed with a lot of measuring operations and arithmetic operations of luminance of grayscale, so that the efficiency of obtaining the luminance signals of different grayscale of LCD is lowered.

Therefore, it is necessary to provide a method and device for obtaining image signals in order to solve the problems of the prior art.

SUMMARY OF THE INVENTION

An object of the present invention is to provide a method and device for obtaining image signals which efficiently obtains luminance signals of different grayscales to solve the problem of the low efficiency of luminance signals of different grayscale switching screens in a traditional method and device for obtaining image signals.

To solve the above problems, the present invention provides the technical solution as following:

The present invention provides a method of obtaining image signals, comprising steps of:

measuring a luminance signal of a grayscale switching screen of a to-be-sampled grayscale;

processing the luminance signal of the grayscale switching screen of the to-be-sampled grayscale by a two-dimensional nonlinear fitting operation to obtain a luminance signal of a full grayscale switching screen; and compensating the luminance of a luminance signal of a low grayscale switching screen in the full grayscale switching screen, wherein the grayscale of the low grayscale switching screen after switching the screen is from 0 to 48;

wherein the two-dimensional nonlinear fitting operation is executed based on a two-dimensional least squares method; and the two-dimensional least squares method comprises steps of:

constructing the following bivariate polynomial function according to the luminance signal of the grayscale switching screen of the to-be-sampled grayscale:

$$f(x, y) = \sum_{ij=1,1}^{p,q} a_{ij}x^{i-1}y^{j-1} = \sum_{i=1}^{p}\sum_{j=1}^{q} a_{ij}x^{i-1}y^{j-1}$$

wherein f(x,y) is the luminance signal of the grayscale switching screen of the to-be-sampled grayscale, x is the grayscale of the to-be-sampled grayscale before switching the screen, y is the grayscale of the to-be-sampled grayscale after switching the screen, p is a sampling number before switching the screen, q is a sampling number after switching the screen, and $a_{ij}$ is a constant coefficient; and constructing the following multivariate function by the two-dimensional least squares method according to the bivariate polynomial function:

$$\sum_{\alpha\beta=1,1}^{p,q}\left[a_{\alpha\beta}\sum_{g=1}^{n}(x_g^{\alpha-1}y_g^{\beta-1}x_g^{i-1}y_g^{j-1})\right] = \sum_{g=1}^{n} x_g^{i-1}y_g^{j-1}z_g$$

wherein z is the luminance signal of the full grayscale switching screen, and n is the number of grayscales of the full grayscale switching screen.

In the method for obtaining image signals of the present invention, wherein the sampling number p before switching the screen is 9, and the sampling number q after switching the screen is 9.

In the method for obtaining image signals of the present invention, wherein the sampling number p before switching the screen is 17, and the sampling number q after switching the screen is 17.

In the method for obtaining image signals of the present invention, wherein the number of grayscales of the full grayscale switching screen before switching the screen is 256, and the number of grayscales of the full grayscale switching screen after switching the screen is 256.

The present invention provides a method of obtaining image signals, comprising steps of:

measuring a luminance signal of a grayscale switching screen of a to-be-sampled grayscale; and processing the luminance signal of the grayscale switching screen of the to-be-sampled grayscale by a two-dimensional nonlinear fitting operation to obtain a luminance signal of a full grayscale switching screen;

wherein the two-dimensional nonlinear fitting operation is executed based on a two-dimensional least squares method.

In the method for obtaining image signals of the present invention, wherein the step of executing the two-dimensional nonlinear fitting operation based on the two-dimensional least squares method comprises:

constructing the following bivariate polynomial function according to the luminance signal of the grayscale switching screen of the to-be-sampled grayscale:

$$f(x, y) = \sum_{ij=1,1}^{p,q} a_{ij}x^{i-1}y^{j-1} = \sum_{i=1}^{p}\sum_{j=1}^{q} a_{ij}x^{i-1}y^{j-1}$$

wherein f(x,y) is the luminance signal of the grayscale switching screen of to-be-sampled grayscale is the function, x is the grayscale of the to-be-sampled grayscale before switching the screen, y is the grayscale of the to-be-sampled grayscale after switching the screen, p is a sampling number before switching the screen, q is a to-be-sampled number after switching the screen, and $a_{ij}$ is a constant coefficient; and constructing a multivariate function by the two-dimensional least squares method according to the bivariate polynomial function:

$$\sum_{\alpha\beta=1,1}^{p,q}\left[a_{\alpha\beta}\sum_{g=1}^{n}(x_g^{\alpha-1}y_g^{\beta-1}x_g^{i-1}y_g^{j-1})\right] = \sum_{g=1}^{n} x_g^{i-1}y_g^{j-1}z_g$$

wherein z is the luminance signal of the full grayscale switching screen, and n is a number of grayscales of the full grayscale switching screen.

In the method for obtaining image signals of the present invention, wherein the sampling number p before switching the screen is 9, and the sampling number q after switching the screen is 9.

In the method for obtaining image signals of the present invention, wherein the sampling number p before switching the screen is 17, and the sampling number q after switching the screen is 17.

In the method for obtaining image signals of the present invention, wherein the number of grayscales of the full grayscale switching screen before switching the screen is 256, and the number of grayscales of the full grayscale switching screen after switching the screen is 256.

In the method for obtaining image signals of the present invention, wherein the method for obtaining image signal further comprises steps of:

compensating the luminance of a luminance signal of a low grayscale switching screen in the full grayscale switching screen, wherein the grayscale of the low grayscale switching screen after switching the screen is from 0 to 48.

The present invention further provides a device for obtaining image signals, comprising:

a luminance measurement module of to-be-sampled grayscale used for measuring a luminance signal of a grayscale switching screen of a to-be-sampled grayscale; and a module of obtaining full grayscale luminance used for processing the luminance signal of the grayscale switching screen of the to-be-sampled grayscale by a two-dimensional nonlinear fitting operation, in order to obtain a luminance signal of a full grayscale switching screen;

wherein the two-dimensional nonlinear fitting operation is executed based on a two-dimensional least squares method.

In the device for obtaining image signals of the present invention, wherein the module of obtaining full grayscale luminance executes the two-dimensional nonlinear fitting operation based on the two-dimensional least squares method which comprises:

constructing the following bivariate polynomial function according to the luminance signal of the grayscale switching screen of the to-be-sampled grayscale:

$$f(x, y) = \sum_{ij=1,1}^{p,q} a_{ij}x^{i-1}y^{j-1} = \sum_{i=1}^{p}\sum_{j=1}^{q} a_{ij}x^{i-1}y^{j-1}$$

wherein f(x,y) is the luminance signal of the grayscale switching screen of the to-be-sampled grayscale is the function, x is the grayscale of the to-be-sampled grayscale before switching the screen, y is the grayscale of the to-be-sampled grayscale after switching the screen, p is a sampling number before switching the screen, q is a sampling number after switching the screen, and $a_{ij}$ is a constant coefficient; and constructing the following multivariate function by the two-dimensional least squares method according to the bivariate polynomial function:

$$\sum_{\alpha\beta=1,1}^{p,q}\left[a_{\alpha\beta}\sum_{g=1}^{n}(x_g^{\alpha-1}y_g^{\beta-1}x_g^{i-1}y_g^{j-1})\right] = \sum_{g=1}^{n} x_g^{i-1}y_g^{j-1}z_g$$

wherein z is the luminance signal of the full grayscale switching screen, and n is a number of grayscales of the full grayscale switching screen.

In the device for obtaining image signals of the present invention, wherein the sampling number p before switching the screen is 9, and the sampling number q after switching the screen is 9.

In the device for obtaining image signals of the present invention, wherein the sampling number p before switching the screen is 17, and the sampling number q after switching the screen is 17.

In the device for obtaining image signals of the present invention, wherein the number of grayscales of the full grayscale switching screen before switching the screen is 258, and the number of grayscales of the full grayscale switching screen after switching the screen is 256.

In the device for obtaining image signals of the present invention, wherein the device for obtaining image signals comprises a compensation module which compensates the luminance for a luminance signal of a low grayscale switching screen in the full grayscale switching screen, and the grayscale of the low grayscale switching screen after switching the screen is from 0 to 48. Compared with the traditional method and device for obtaining image signals, the method and device for obtaining image signals of the present invention processes the luminance signal of the grayscale switching screen of the to-be-sampled grayscale by a two-dimensional nonlinear fitting operation to obtain a luminance signal of a full grayscale switching screen, so that the luminance signals of different grayscale can be efficiently obtained to solve the problem of the low efficiency of luminance signals of the different grayscale switching screens in the traditional method and device for obtaining image signals.

The above-mentioned content of the present invention can be best understood by referring to the following detailed description of the preferred embodiments and the accompanying drawings.

DETAILED DESCRIPTION OF THE PREFERRED EMBODIMENTS

Figure 1:
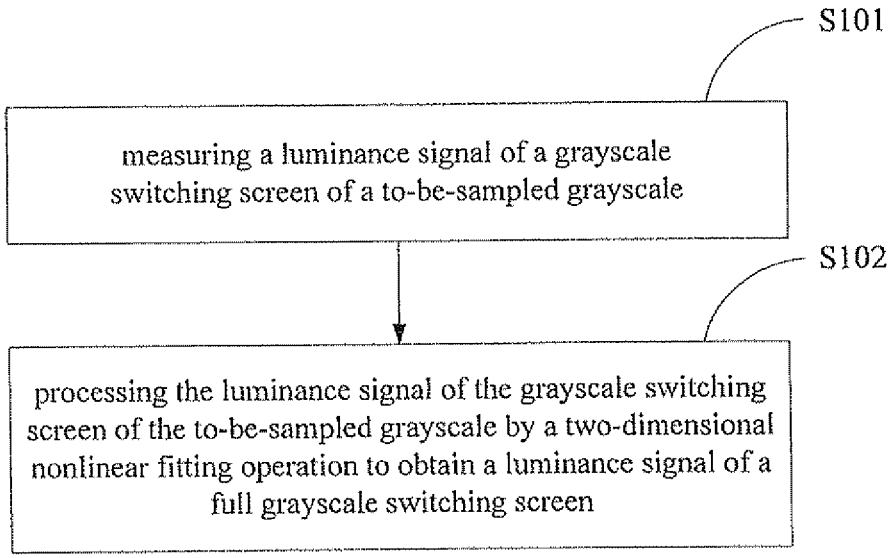
FIG. 1 is a flow chart of a method for obtaining image signals according to the first preferred embodiment of the present invention.

The structure and the technical means adopted by the present invention to achieve the above and other objects can be best understood by referring to the following detailed description of the preferred embodiments and the accompanying drawings. Furthermore, directional terms described by the present invention, such as upper, lower, front, back, left, right, inner, outer, side, longitudinal/vertical, transverse/horizontal, etc., are only directions by referring to the accompanying drawings, and thus the used directional terms are used to describe and understand the present invention, but the present invention is not limited thereto.

Similar structural elements use the same reference numerals in the drawings.

The method and device for obtaining image signals of the present invention are applied to a corresponding 3D shutter LCD device. The 3D shutter LCD device comprises a shutter LCD and a shutter glasses. Wherein the shutter LCD has a backlight, an LCD panel, and a drive circuit driving the LCD panel to display. The display of the left eye and the right eye are alternately produced on the LCD panel by a higher refreshing frequency (higher than 120 Hz), and the shutter glasses switch the lens of left eye and the right eye to open and close with the same refreshing frequency. Users can experience the 3D image better by using the shutter glasses. The method and device for obtaining image signals of the present invention are used/deposed in the drive circuit of the shutter LCD, the display can avoid the crosstalk by driving an LCD panel better.

Referring to FIG. 1, FIG. 1 is a flow chart of a method for obtaining image signals according to the first preferred embodiment of the present invention. The method for obtaining image signals of the preferred embodiment comprises steps of:

In a step (S101), measuring a luminance signal of a grayscale switching screen of a to-be-sampled grayscale; and In a step (S102), processing the luminance signal of the grayscale switching screen of the to-be-sampled grayscale by a two-dimensional nonlinear fitting operation to obtain a luminance signal of a full grayscale switching screen;

The method of obtaining the image signals of the preferred embodiment is finished in the step (S102).

The specific processes of the steps of the method for obtaining the image signals of the preferred embodiment are fully described as follows:

In the step (S101), measuring a luminance signal of a grayscale switching screen of a to-be-sampled grayscale (overdriven signals), the to-be-sampled grayscale has a grayscale before switching the screen (the screen of the left eye) and a grayscale after switching the screen (the screen of the right eye), wherein the sampling number before switching the screen is 17, and the sampling number after switching the screen is 17, 15 of intermediate grayscale screens are uniformly set between a grayscale of full dark screen and a grayscale of a full white screen, the to-be-sampled grayscales before switching screen and after switching the screen are 0 (full dark screen), 16, 32, 48, 64, 80, 96, 112, 128, 144, 160, 176, 192, 208, 224, 240, 255 (full white screen). Specifically, the grayscale before switching the screen is set to 0, and the driving luminance signal after switching the screen of 17 grayscales are measured after switching; the grayscale before switching the screen is set to 16, the driving luminance signal after switching the screen of 17 grayscales are measured after switching, until the grayscale before switching the screen is set to 255; thereby the 17×17 array of the luminance signal of the grayscale switching screen of the to-be-sampled grayscale can be obtained. The obtained luminance signals of grayscale switching screens of the different to-be-sampled grayscale will not produce crosstalk when switching the screen. Then, going to step (S102).

In the step (S102), the 17×17 array of the luminance signal is processed by a two-dimensional nonlinear fitting operation, so that a luminance signal of a full grayscale switching screen of the 256×256 array can be obtained. In the preferred embodiment, the two-dimensional nonlinear fitting operation is executed based on a two-dimensional least squares method. Constructing the following bivariate polynomial function according to the luminance signal of the grayscale switching screen of the to-be-sampled grayscale (17×17 array):

$$f(x, y) = \sum_{ij=1,1}^{p,q} a_{ij}x^{i-1}y^{j-1} = \sum_{i=1}^{p}\sum_{j=1}^{q} a_{ij}x^{i-1}y^{j-1}$$

wherein $f(x,y)$ is the luminance signal of the grayscale switching screen of the to-be-sampled grayscale, x is the grayscale of the to-be-sampled grayscale before switching the screen, y is the grayscale of the to-be-sampled grayscale after switching the screen, p is a sampling number before switching the screen, q is a sampling number after switching the screen, and $a_{ij}$ is a constant coefficient;

Then, constructing the following bivariate polynomial function with $a_{ij}$ based on a two-dimensional least squares method.

$$s(a_{11}, \ldots, a_{pq}) = \sum_{g=1}^{n} \omega_g[f(x_g, y_g) - z_g]^2 = \sum_{g=1}^{n} \omega_g\left(\sum_{i=1}^{p}\sum_{j=1}^{q} a_{ij}x^{i-1}y^{j-1} - z_g\right)^2$$

wherein $(a_{11}, \ldots, a_{pq})$ is the minimum point of the bivariate polynomial function $s(a_{11}, \ldots, a_{pq})$, wherein $\omega_g$ is a weight function, when $\omega_g=1$:

$$\frac{\partial s}{\partial a_{ij}} = \frac{\partial}{\partial a_{ij}}\sum_{g=1}^{n}[f(x_g, y_g) - z_g]^2$$

-continued $$= \sum_{g=1}^{n} \left\{ 2[f(x_g, y_g) - z_g] \frac{\partial}{\partial a_{ij}} [f(x_g, y_g)] \right\}$$

$$= \sum_{g=1}^{n} \{2[f(x_g, y_g) - z_g] x_g^{i-1} y_g^{j-1}\}$$

$$= 2\sum_{g=1}^{n} [x_g^{i-1} y_g^{j-1} f(x_g, y_g) - x_g^{i-1} y_g^{j-1} z_g] = 0$$

Therefore, the polynomial function can be found, $$\sum_{g=1}^{n} x_g^{i-1} y_g^{j-1} f(x_g, y_g) = \sum_{g=1}^{n} x_g^{i-1} y_g^{j-1} z_g$$

$$\sum_{g=1}^{n} x_g^{i-1} y_g^{j-1} \sum_{\alpha=1}^{p} \sum_{\beta=1}^{q} a_{\alpha\beta} x_g^{\alpha-1} y_g^{\beta-1} = \sum_{g=1}^{n} x_g^{i-1} y_g^{j-1} z_g$$

$$\sum_{g=1}^{n} x_g^{i-1} y_g^{j-1} \sum_{\alpha\beta=1,1}^{p,q} a_{\alpha\beta} x_g^{\alpha-1} y_g^{\beta-1} = \sum_{g=1}^{n} x_g^{i-1} y_g^{j-1} z_g$$

$$\sum_{\alpha\beta=1,1}^{p,q} \left[ a_{\alpha\beta} \sum_{g=1}^{n} (x_g^{\alpha-1} y_g^{\beta-1} x_g^{i-1} y_g^{j-1}) \right] = \sum_{g=1}^{n} x_g^{i-1} y_g^{j-1} z_g$$

wherein z is the luminance signals of the full grayscale switching screen, and n is the number of grayscales of the full grayscale switching screen.

According to the corresponding surface of $$\sum_{\alpha\beta=1,1}^{p,q} \left[ a_{\alpha\beta} \sum_{g=1}^{n} (x_g^{\alpha-1} y_g^{\beta-1} x_g^{i-1} y_g^{j-1}) \right] = \sum_{g=1}^{n} x_g^{i-1} y_g^{j-1} z_g,$$

luminance signals of the full grayscale switching screen can be obtained. By selecting the corresponding grayscale $x_g$ before switching the screen and grayscale $y_g$ after switching the screen on the surface, the luminance signal $z_g$ for switching the screen can be obtained, and the luminance signal of the full grayscale switching screen of the 256×256 array can be obtained.

Thus, the obtaining process of the method for obtaining image signals of the preferred embodiment can be finished.

In the method for obtaining image signals of a preferred embodiment, wherein the sampling number p before switching the screen can be 9, and the sampling number q after switching the screen also is 9, the workload of measuring operation of the luminance signals can be further reduced, but a portion of the accuracy of obtaining the luminance signals of the full grayscale switching screen may be lost.

The method for obtaining image signals of the preferred embodiment processes the luminance signals of the grayscale switching screen of the to-be-sampled grayscale by a two-dimensional nonlinear fitting operation to obtain a luminance signal of a full grayscale switching screen, so that the luminance signals of different grayscales can be efficiently obtained.

Figure 2:
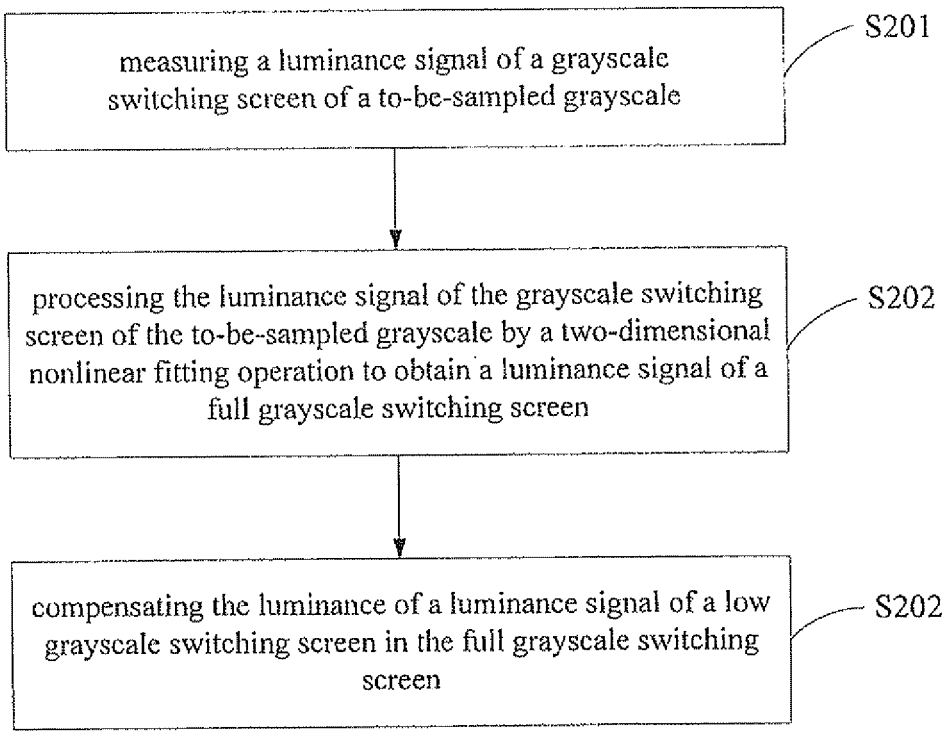
FIG. 2 is a flow chart of a method for obtaining image signals according to the second preferred embodiment of the present invention.

Referring to FIG. 2, FIG. 2 is a flow chart of a method for obtaining image signals according to the second preferred embodiment of the present invention. The method for obtaining image signals of the preferred embodiment comprises steps of:

In a step (S201), measuring a luminance signal of a grayscale switching screen of a to-be-sampled grayscale;

In a step (S202), processing the luminance signal of the grayscale switching screen of the to-be-sampled grayscale by a two-dimensional nonlinear fitting operation to obtain a luminance signal of a full grayscale switching screen; and In a step (S203), compensating the luminance of a luminance signal of a low grayscale switching screen in the full grayscale switching screen;

The method for obtaining image signals of the second preferred embodiment is finished in the step (S203).

The specific processes of the steps of the method for obtaining image signals of the preferred embodiment are fully described as follows.

The specific process of the step (S201) is similar to the specific process of the step (S101) of the first embodiment of the method for obtaining image signals (please refer to the step (S101) of the first embodiment of the method for obtaining image signals).

The specific process of the step (S202) is similar to the specific process of the step (S102) of the first embodiment of the method for obtaining image signals (please refer to the step (S102) of the first embodiment of the method for obtaining image signals).

In the step (S203), the luminance signal of a low grayscale switching screen in the full grayscale switching screen which is obtained from the step (S202) compensates the luminance.

The low grayscale switching screen is a low grayscale after switching the screen, i.e. the grayscale is 0 to 48 after switching the screen. The surface of the luminance signals of the full grayscale switching screen obtained by the two-dimensional nonlinear fitting operation has a portion which is a low grayscale switching screen and is not accurate (e.g. the grayscale is 0 before switching the screen and the grayscale is 16 after switching the screen; the grayscale is 16 before switching the screen and the grayscale is 32 after switching the screen). The luminance signal representing the portion of the surface needs to be compensated, and the luminance signal after compensating is generally about 30% of the luminance signal representing the surface of the luminance signals of the full grayscale switching screen obtained by the two-dimensional nonlinear fitting operation, i.e. the luminance signals obtained through the surface reduced about 70%. The luminance signals of the full grayscale switching screen after compensating are more accurate.

Thus, the obtaining process of the method for obtaining image signals of the preferred embodiment can be finished.

The method for obtaining image signals of the preferred embodiment compensates the luminance of a luminance signal of the full grayscale switching screen based on the first preferred embodiment, so that the luminance signal of the full grayscale switching screen can be more accurate.

Figure 3:
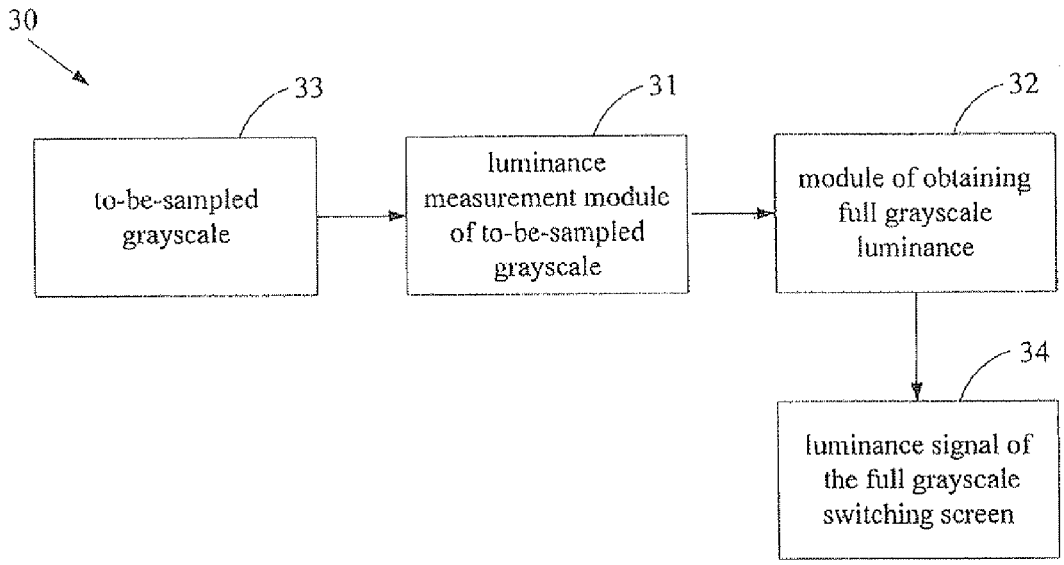
FIG. 3 is a schematic view of a device for obtaining image signals according to the first preferred embodiment of the present invention.

The present invention further provides a device for obtaining image signals. Referring to FIG. 3, FIG. 3 is a schematic view of a device for obtaining image signals according to the first preferred embodiment of the present invention. The device 30 for obtaining image signals of the present invention comprises a luminance measurement module of to-be-sampled grayscale 31 and a module for obtaining full grayscale luminance 32. The luminance measurement module of to-be-sampled grayscale 31 is used for measuring a luminance signal of a grayscale switching screen of a to-be-sampled grayscale 33, the module for obtaining full grayscale luminance 32 is used for processing the luminance signal of the grayscale switching screen of the to-be-sampled grayscale 33 by a two-dimensional nonlinear fitting operation, in order to obtain a luminance signal of a full grayscale switching screen 34, wherein the module for obtaining full grayscale luminance 32 executes the two-dimensional nonlinear fitting operation based on the two-dimensional least squares method.

When using the device 30 of obtaining image signals of the present invention, the luminance measurement module of the to-be-sampled grayscale 31 firstly measures the luminance signal of a full grayscale switching screen of the to-be-sampled grayscale 33, and the module for obtaining full grayscale luminance 32 then processes the luminance signal of the grayscale switching screen of the to-be-sampled grayscale 33 by a two-dimensional nonlinear fitting operation to obtain a luminance signal of a full grayscale switching screen 34.

Thus, the obtaining process of the device 30 for obtaining image signals of the preferred embodiment can be finished.

The specific process of the device 30 for obtaining image signals of the present invention is similar to the description of the first embodiment of the method of obtaining image signals. Please refer to the description of the first embodiment of the method, for obtaining image signals.

The device for obtaining image signals of the preferred embodiment processes the luminance signals of the grayscale switching screen of the to-be-sampled grayscale by a two-dimensional nonlinear fitting operation to obtain a luminance signal of a full grayscale switching screen, so that the luminance signals of different grayscales can be efficiently obtained.

Figure 4:
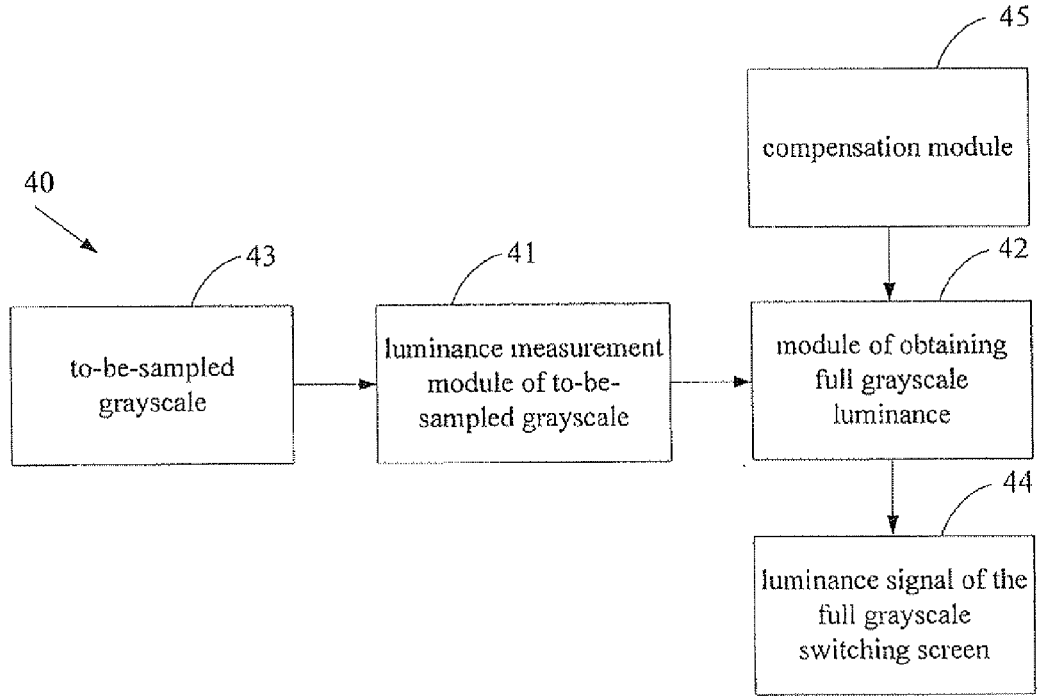
FIG. 4 is a schematic view of a device for obtaining image signals according to the second preferred embodiment of the present invention.

Referring to FIG. 4, FIG. 4 is a schematic view of a device for obtaining image signals according to the second preferred embodiment of the present invention. The device 40 for obtaining image signals of the present invention comprises a luminance measurement module of the to-be-sampled grayscale 41, a module of obtaining full grayscale luminance 42, and a compensation module 45. The luminance measurement module of the to-be-sampled grayscale 41 is used for measuring a luminance signal of a grayscale switching screen of the to-be-sampled grayscale 43, and the module for obtaining full grayscale luminance 42 is used for processing the luminance signal of the grayscale switching screen of the to-be-sampled grayscale 43 by a two-dimensional nonlinear fitting operation, in order to obtain a luminance signal of a full grayscale switching screen 44, wherein the module for obtaining the full grayscale luminance 42 executes the two-dimensional nonlinear fitting operation based on the two-dimensional least squares method, and the compensation module 45 compensates the luminance for a luminance signal of a low grayscale switching screen in the full grayscale switching screen, and the grayscale of the low grayscale switching screen after switching the screen is from 0 to 48 When using the device 40 for obtaining image signals of the present invention, first, the luminance measurement module of the to-be-sampled grayscale 41 measures the luminance signal of a full grayscale switching screen of the to-be-sampled grayscale 43, and the module of obtaining the full grayscale luminance 42 processes the luminance signal of the grayscale switching screen of the to-be-sampled grayscale 43 by a two-dimensional nonlinear fitting operation to obtain a luminance signal of the full grayscale switching screen 44. Finally, the compensation module 45 compensates the luminance for a luminance signal of a low grayscale switching screen in the full grayscale switching screen.

Thus the obtaining process of the device 40 for obtaining image signals of the preferred embodiment can be finished.

The specific process of the device 40 for obtaining image signals of the present invention is similar to the description of the second embodiment of the method of obtaining image signals. Please refer to the description of the second embodiment of the method for obtaining image signals.

The device for obtaining image signals of the preferred embodiment compensates the luminance of a luminance signal of the full grayscale switching screen based on the first preferred embodiment, so that the luminance signal of the full grayscale switching screen can be more accurate.

Figure 5:
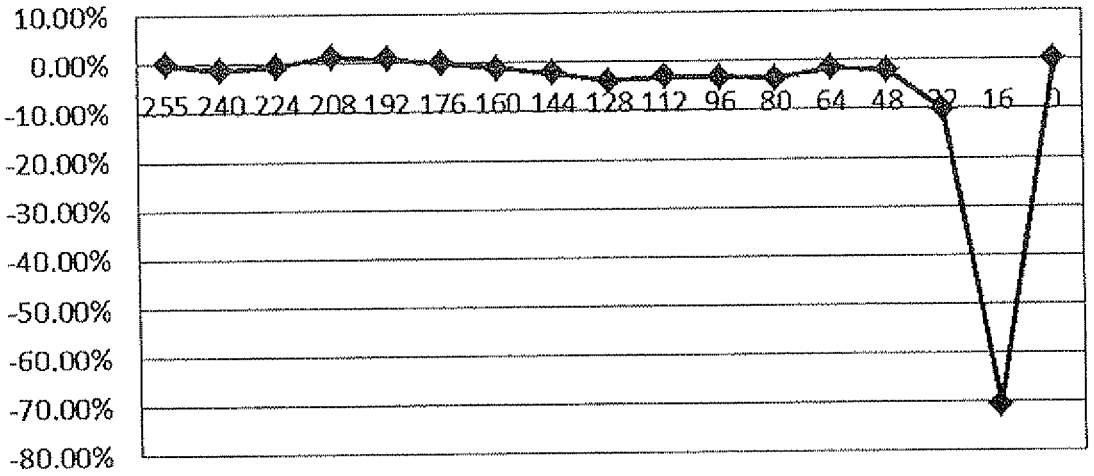
FIG. 5 is a schematic view comparing the obtained luminance signals of the method of the present invention and the obtained luminance signals by introducing a method for measuring luminance signals of 64×64 grayscale.

Referring to FIG. 5, FIG. 5 is a schematic view comparing the obtaining luminance signals of the method of the present invention and the obtaining luminance signals by introducing a method for measuring luminance signals of 64×64 grayscales.

In FIG. 5, the abscissa is a grayscale after switching the screen, the ordinate is the difference between two types of luminance signals, and the grayscale before switching the screen is 0. In the drawing, obtaining luminance signals in the method for obtaining image signals of the present invention are only limited to the low grayscale switching screen, which is different from the method introduced for measuring luminance signals of 64×64 grayscales; Therefore, the luminance compensated by the luminance signals of the low grayscale switching screen in the full grayscale switching screen and the obtaining luminance signals in the method for obtaining image signals of the present invention are consistent with the method for measuring luminance signals of 64×84 grayscales. The method for obtaining image signals of the present invention only needs to measure luminance signals of 17×17 grayscales, the measurement time of which is a quarter of that of the method for measuring luminance signals of 64×64 grayscales. Thus, the method for obtaining image signals of the present invention increases the efficiency of obtaining luminance signals of different grayscale switching screens of LCDs.

The method and device for obtaining image signals of the present invention processes the luminance signal of the grayscale switching screen of the to-be-sampled grayscale by a two-dimensional nonlinear fitting operation to obtain a luminance signal of a full grayscale switching screen, so that the luminance signals of different grayscales can be efficiently obtained to solve the problem of the low efficiency of the luminance signals of different grayscale switching screens in the traditional method and devices for obtaining image signals.

The present invention has been described with a preferred embodiment thereof and it is understood that many changes and modifications to the described embodiment can be carried out without departing from the scope and the spirit of the invention that is intended to be limited only by the appended claims.

What is claimed is:

1. A method for obtaining image signals, comprising steps of:

measuring a luminance signal of a grayscale switching screen of a to-be-sampled grayscale, wherein a grayscale before switching the screen is set to 0, and the luminance signals of the screen of 17 grayscales are measured after switching; the grayscale before switching the screen is set to 16, and the luminance signal after switching the screen of 17 grayscales are measured after switching, until the grayscale before switching the screen is set to 255; and processing the luminance signal of the grayscale switching screen of the to-be-sampled grayscale by a two-dimensional nonlinear fitting operation to obtain a luminance signal of a full grayscale switching screen; and compensating the luminance of a luminance signal of a low grayscale switching screen in the full grayscale switching screen, wherein the luminance signal after compensating is about 30% of the luminance signal representing the surface of the luminance signals of the full grayscale switching screen obtained by the two-dimensional nonlinear fitting operation;

wherein the two-dimensional nonlinear fitting operation is executed based on a two-dimensional method of least squares method, and a grayscale of the low grayscale switching screen after switching a screen is from 0 to 48.

* * * * *